United States Patent [19]

Stout

[11] 4,261,184

[45] Apr. 14, 1981

[54] VANE GUIDES FOR ROTARY VANE GAS CYCLE APPARATUS

[76] Inventor: Robert L. Stout, 5860 Charlesgate Rd., Dayton, Ohio 45424

[21] Appl. No.: 89,792

[22] Filed: Oct. 31, 1979

[51] Int. Cl.[3] ..... F25D 9/00

[52] U.S. Cl. ..... 62/402; 418/259

[58] Field of Search ..... 62/402; 418/266, 267, 418/268, 269, 259, 270

[56] References Cited

U.S. PATENT DOCUMENTS

| | | | |
|---|---|---|---|
| 582,280 | 5/1897 | Goodwin et al. | 418/266 |
| 867,172 | 9/1907 | Troup et al. | 418/266 |
| 1,350,168 | 8/1920 | Mulinex | 418/269 |
| 1,758,320 | 5/1930 | Hoss | 418/266 |
| 3,967,466 | 7/1976 | Edwards | 62/402 |
| 3,977,852 | 8/1976 | Edwards | 62/402 |

*Primary Examiner*—Ronald C. Capossela

*Attorney, Agent, or Firm*—Donald J. Singer; Richard J. Killoren

[57] ABSTRACT

A rotary vane gas cycle apparatus having radial vane guide slots in the rotor for receiving vane guides on the rotor vanes which slide in the slots. One or more radial guides are provided for each vane. In one embodiment a vane guide is provided on one side of the vane. The rotor guide slots restrict movement of the vane toward or away from the guide slot.

4 Claims, 3 Drawing Figures

VANE GUIDES FOR ROTARY VANE GAS CYCLE APPARATUS

RIGHTS OF THE GOVERNMENT

The invention described herein may be manufactured and used by or for the Government of the United States for all governmental purposes without the payment of any royalty.

BACKGROUND OF THE INVENTION

This invention relates to a rotary vane gas cycle apparatus.

In rotary vane gas cycle apparatus, such as a reverse Brayton cycle cooling system described in the U.S. Pat. Nos. to Edward, 3,967,466 and 3,977,852, compression and expansion is obtained by the radial movement of vanes in slots in a rotor. Various means have been used, such as bearings and cams, to control the movement of the vanes in the slots to reduce end wear on the vanes. Conventional means used however, permit axial and radial twisting of the vanes in the slots thus requiring greater end clearance to eliminate uneven wear on the vane ends. The added clearance results in greater thrust loading of the bearings. Movement of the vanes in the slots also add to the frictional loading of the apparatus.

BRIEF SUMMARY OF THE INVENTION

According to this invention vane guides are provided to control movement of the vanes in the rotor slots to substantially eliminate axial and radial skewing of the vanes. With the use of the vane guides, the vane faces can be spaced a greater distance from the sides of the rotor slots thus reducing the frictional loads. Also the end clearance between the vanes and the end walls can be reduced to decrease blowby. Thrust loading of the bearings is also susbtantially reduced.

IN THE DRAWINGS

DETAILED DESCRIPTION OF THE INVENTION

Figure 1:
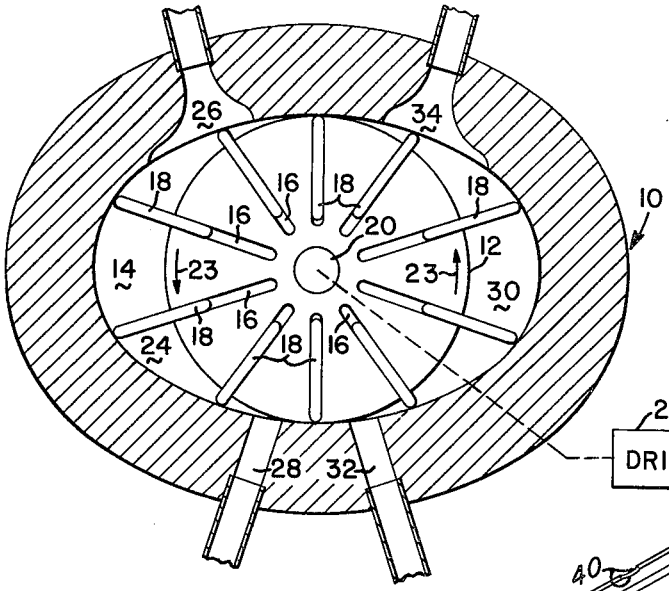
Fig. 1 PRIOR ART
FIG. 1 is a schematic sectional view of a conventional rotary vane air cycle apparatus.

Reference is now made to FIG. 1 of the drawing which shows a conventional rotary vane air cycle apparatus 10 such as used in a reverse Brayton cycle cooling system. The rotary vane air cycle apparatus 10 includes a rotor 12 within a chamber 14. The rotor includes a plurality of radial slots 16 with movable vanes 18. The rotor 12 is driven through shaft 20 by a drive indicated at 22. Compression and expansion is obtained by the change in volume between adjacent vanes as the shaft 20 rotates. With rotation as indicated at 23 the compressor 24 has an inlet port at 26 and an outlet port at 28. The expander 30 has an inlet port at 32 and an outlet port at 34.

Figure 2:
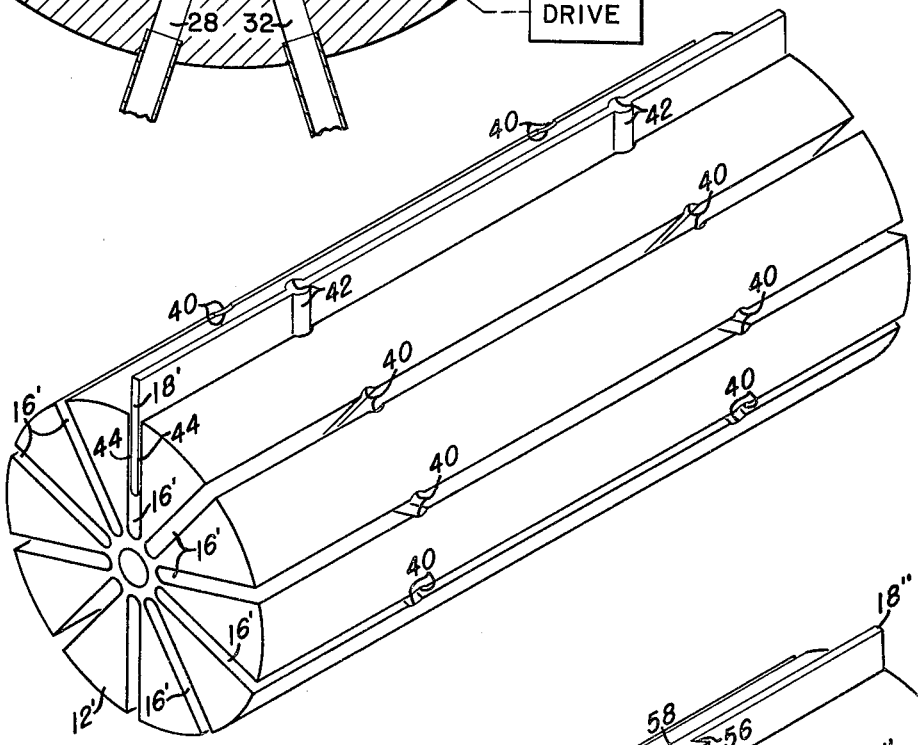
FIG. 2 is a partially schematic view of a rotor assembly, according to the invention, for use in a rotary vane air cycle apparatus, such as shown in FIG. 1.

According to this invention the rotor 12 is constructed as shown in FIG. 2. The rotor slots 16' are provided with radial vane guide tracks 40 with the shape of cylindrical segments and the vanes 18' are provided with vane guides 42 with the shape of cylindrical segments. The vane guides 42 act to space the vanes from the sides of the slots 16' as indicated schematically at 44 to reduce the frictional load. While only two vane guides are shown on each side of the blade more than two may be required, in some applications, to overcome the problem of localized heating.

The vane guides would be lubicated in a conventional manner, for example lubricant could be supplied to the vane guide tracks 40 or the vane guides 42 could be made to include materials with self lubricating properties.

Figure 3:
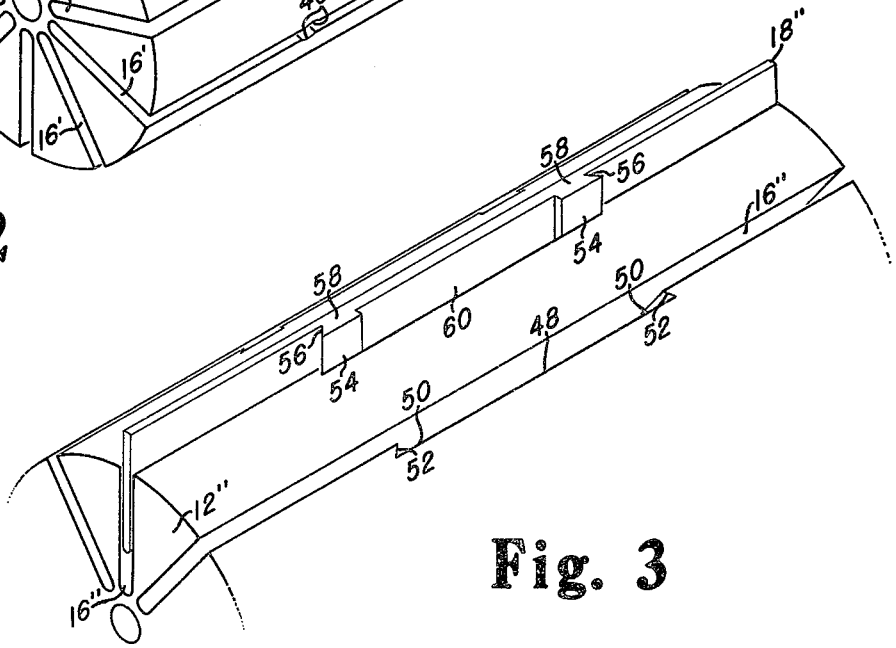
FIG. 3 is a partially cut away schematic view of a modified rotor assembly for use in a rotary vane air cycle apparatus.

While vane guides have been shown on opposite sides of the vanes in FIG. 2, vane guides could be provided on only one side of the vanes as shown in FIG. 3 wherein vane guide tracks 48 are provided with guide surfaces 50 and 52 for engaging surfaces 54 and 56 on vane guides 58. A space 60 is provided between the vane guide surfaces 54 to reduce friction. If a plurality of smaller guide tracks such as 48 were used the space 60 could be omitted. The showing in FIG. 2 is the preferred embodiment since it is easier to manufacture. Vane guide configurations other than those shown could be used. The vane guides can be made integral with the vanes, such as when the vanes are made as composite structures, or the vane guides can be made as separate elements and can then be secured to the vanes with bolts or other well known means.

In the operation of the device the rotary air cycle apparatus operates in a conventional manner with conventional vane actuation apparatus, not shown, controlling the movement of the vanes 18' in slots 16'. The vane guides 42 move in guide tracks 40 and space the vanes 18' from the sides of slots 16'. The vane guides also keep the vanes from skewing in the slots and reduce end wear on the vanes. The vane guides act to reduce thrust loading on cam bearings in devices using cam actuated vanes.

There is thus provided apparatus for use in a rotary gas cycle device for reducing frictional loading and for reducing vane wear.

I claim:

1. A rotary vane gas cycle apparatus, comprising: a compressor and an expander driven by a common shaft; said compressor and expander including a rotor having vanes which form a plurality of cells which change in volume as the shaft rotates; said compressor having an inlet port and an outlet port; said expander having an inlet port and an outlet port; said rotor including a plurality of radial slots with said vanes being positioned in said slots; means for controlling said vanes in said slots; said means including guide tracks in said slots; and guide members projecting outwardly from said vanes in contiguous engagement with said guide tracks; said guide members being elongated and extending substantially parallel to each other and to said vanes.

2. The device as recited in claim 1 wherein said guide members extend along a single side surface of said vanes; said guide tracks and said guide members having means for confining movement of said guide members along said guide tracks.

3. The device as recited in claim 1 wherein a plurality of guide members project outwardly from opposite sides of said vanes into contiguous engagement with said guide tracks.

4. The device as recited in claim 3 wherein said guide tracks and said guide members have the shape of complementary cylindrical segments.

* * * * *